United States Patent [19]

Donahue

[11] 4,221,393

[45] Sep. 9, 1980

[54] SKI POLE AND SNOW SCRAPER

[76] Inventor: Arnold Donahue, 2302 N. 11th St., Apt. 302, Arlington, Va. 22201

[21] Appl. No.: 11,044

[22] Filed: Feb. 9, 1979

[51] Int. Cl.[3] ..... A63C 11/18

[52] U.S. Cl. ..... 280/813; 15/237

[58] Field of Search ..... 280/11.37 B, 11.37 D, 280/11.37 E, 11.37 L, 164 A; 15/236 R, 237; D7/182

[56] References Cited

U.S. PATENT DOCUMENTS

| | | | |
|---|---|---|---|
| 2,360,240 | 10/1944 | Kjellstrom | 280/11.37 L |
| 3,350,111 | 10/1967 | Sahlein et al. | 280/11.37 E |
| 3,596,921 | 8/1971 | Bruckl | 280/11.37 L |
| 3,929,345 | 12/1975 | Nasby | 280/11.37 E |
| 3,999,773 | 12/1976 | Shuttleworth | 280/11.37 E |
| 4,000,909 | 1/1977 | Coale | 280/11.37 E |

FOREIGN PATENT DOCUMENTS

| | | | |
|---|---|---|---|
| 78501 | 4/1950 | Norway | 280/11.37 E |

*Primary Examiner*—John J. Love
*Assistant Examiner*—Michael Mar

[57] ABSTRACT

This invention relates to ski poles in general and more specifically to a ski pole shaft manufactured from plastic and having an integral recessed portion which functions as a snow and ice scraper to clean the bottom of a ski boot so that the boot will fit securely in the binding of the ski.

4 Claims, 5 Drawing Figures

SKI POLE AND SNOW SCRAPER

SUMMARY OF THE INVENTION

Most if not all, skiers have experienced difficulty in removing caked ice or snow from the bottom of their ski boots prior to inserting them into the bindings of their skis. Some of the structures which have been used in the past to solve this problem are depicted in U.S. Pat. Nos. 3,929,345, 4,000,909 and 3,999,773. All of these employ some sort of protrusion which forms the scraping surface.

Another problem that faces skiers, is the high cost of ski poles. This is occassioned for the most part due to the hollow, tubular metallic construction of the ski pole shaft, which is manufactured by an extrusion process or similar method. While most modern ski poles are lightweight and relatively rigid, they remain expensive to the average consumer.

It is an object of this invention to provide a low cost ski pole which is easily manufactured.

It is another object of this invention to provide a lightweight rigid plastic ski pole which has a recessed portion formed integrally with the shaft to provide a snow and ice scraping surface.

It is a further object of this invention to provide a solid shaft for a ski pole which can be mass produced at a fraction of the cost of the ski poles currently in use.

It is still yet another object of the present invention to provide a ski pole which possesses most if not all of the characteristics of the tubular metal poles, but which is manufactured from plastic or fiberglass.

These and other objects and advantages of the instant invention will become apparent when viewed in light of the accompanying drawings and detailed description which follows.

DESCRIPTION OF THE PREFERRED EMBODIMENT

Figure 1:
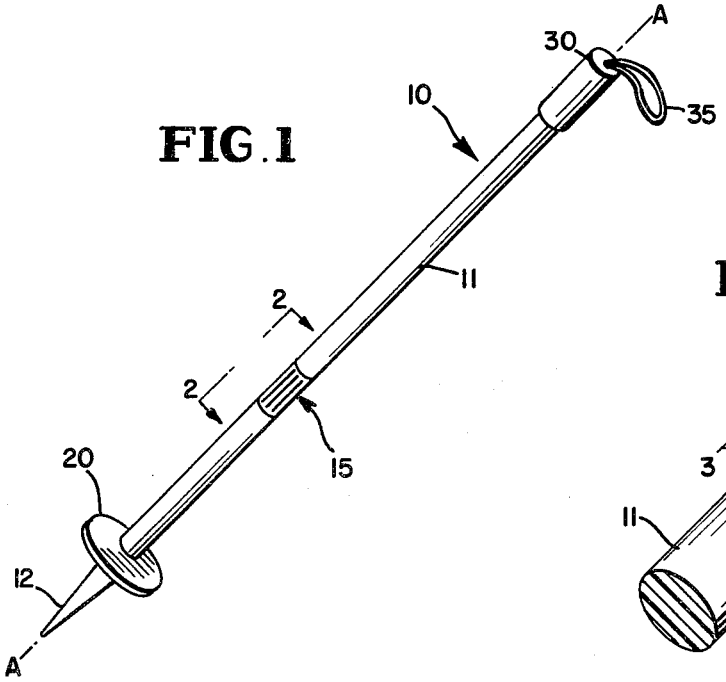
FIG. 1 is a perspective view of the ski pole of the instant invention showing one location of the recessed scraper on the pole shaft.

Referring now to the drawings where like refernce numerals designate like elements, the ski pole of the instant invention in FIG. 1 is designated generally as 10. The ski pole 10 comprises a shaft 11 having an integral handle 30 with a strap 35 attached thereto, a snow pad 20 positioned adjacent its tapered point 12 and a recessed snow scraping element 15 located along the axis A—A of the shaft 11.

The shaft member 11 and handle 30 are fabricated from a rigid light-weight plastic material and may be manufactured by injection molding or similar methods suitable to high speed mass production. The particular plastic material chosen is not deemed to be part of this invention, with the choice being dictated by the following characteristics, rigidness, durability, lightness, low cost, and lack of brittleness at the low temperatures normally prevailing during skiing weather.

Figure 2:
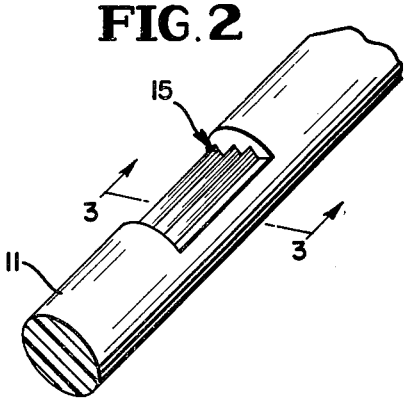
FIG. 2 is a partial cross-sectional view of the ski pole taken through line 2—2 of FIG. 1 showing the recessed scraper in detail.

In the preferred embodiment shown in FIGS. 1–3, the shaft 11 is solid (not tubular or hollow) and has a generally cylindrical external configuration which terminates in a tapered point 12 below the snow pad 20.

The shaft may also have a tapered external configuration running along its entire length depending on the location of the scraper element 15 on the shaft axis A—A.

As can be seen by reference to FIGS. 2 and 3, the scraper element 15 comprises a plurality of scraper surfaces 17 which are recessed below the circular periphery of the shaft cross-section (either in the cylindrical or the tapered version). The recesses are formed in the molding process or by grinding, cutting, etc.

Figure 3:
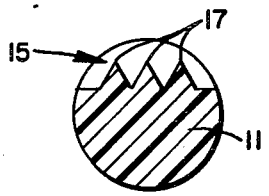
FIG. 3 is an end cross-sectional view of the ski pole taken through line 3—3 of FIg. 2 showing one proposed scraper configuration.

In FIG. 3 the recess forms a plurality of triangular shaped scraper teeth 17 which extend along the axis A—A of the shaft 11. The length of the scraping members 17 are longer than the greatest width of any commercially available ski boot in order that the boot may easily be accommodated within the scraping recess 15.

Figure 4:
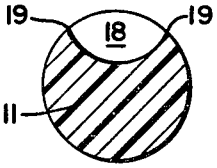
FIG. 4 is an end cross sectional view of another proposed scraper surface configuration.

In FIG. 4 a modified version of the scraper recess 15 is shown which employs an arcuate recess 18 which forms a plurality of scraper surfaces 19. The arcuate recess provides a smooth curved surface which will not collect the caked, scraped snow from the boot between the spaced scraper surfaces 19.

The recessed portion 15 can assume a variety of configurations, with the only limitation being that the scraping surfaces are positioned inside the circumference of the adjacent shaft member cross section 11. The reason for the recess is two-fold; first of all the recessed scraper will not snag on clothing or other items, and secondly, it requires less material (plastic) in its manufacture.

Figure 5:
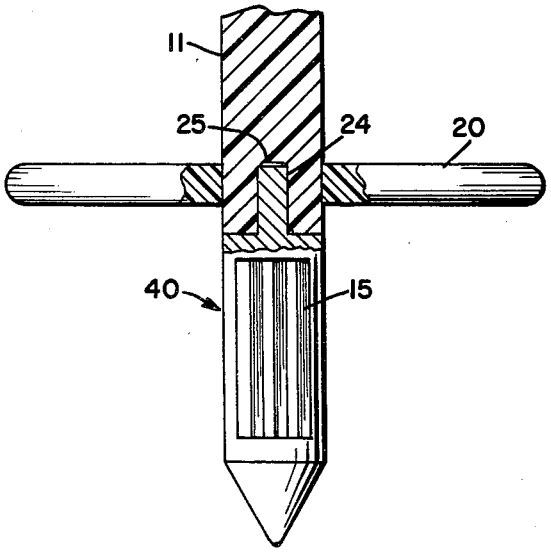
FIG. 5 is a side view of the tip of the ski pole incorporating a modified version of the instant invention.

One proposed modification is shown in FIG. 5 wherein the plastic shaft 11 is provided with a central recess 24 which receives a metal point member 40. The metal point member 40 has an elongated central portion 25 which fits in the recess 24 in the shaft 11. The metal point is secured in the plastic shaft by any suitable securing means such as threaded coupling, adhesive, etc. and functions as a stiffening member and wear reducing element. In the modified version, the recessed portion 15 may be located on the metal point 40 or on the plastic shaft 11 proper.

Having thus described the invention in detail, it should be obvious to one of ordinary skill in the art that various modifications, substitutions, and variations may be made within the scope and spirit of the invention, and that the invention should only be limited by the breadth of the appended claims.

I claim:

1. An improved ski pole construction for use with a ski boot wherein;

the ski pole comprises the following elements; a handle, a shaft member and tapered point, an integral recessed snow scraper member formed on the ski pole, and the recessed snow scraper comprises a plurality of parallel pointed elongated scraping surfaces recessed within the circumference of the ski pole, wherein the length of the elongated recess will accommodate the width of a ski boot.

2. An improved ski pole construction as in claim 1, wherein, the integral recessed snow scraper member is formed on the tapered point.

3. An improved ski pole construction as in claim 1, wherein, the integral recessed snow scraper member is formed on the handle.

4. An improved ski pole construction as in claim 1, wherein, the integral recessed snow scraper member is formed on the shaft member.

* * * * *